US008649544B2

(12) United States Patent
Voishvillo

(10) Patent No.: US 8,649,544 B2
(45) Date of Patent: Feb. 11, 2014

(54) PHASING PLUG FOR A COMPRESSION DRIVER

(75) Inventor: Alexander Voishvillo, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 184 days.

(21) Appl. No.: 13/270,102

(22) Filed: Oct. 10, 2011

(65) Prior Publication Data

US 2012/0027238 A1 Feb. 2, 2012

Related U.S. Application Data

(63) Continuation of application No. 11/317,654, filed on Dec. 22, 2005, now Pat. No. 8,036,408.

(51) Int. Cl.
*H04R 1/20* (2006.01)

(52) U.S. Cl.
USPC ..... 381/343; 381/340; 181/177; 181/179; 181/182; 181/184; 181/185; 181/187; 181/188

(58) Field of Classification Search
USPC ..... 381/343; 181/177–195
See application file for complete search history.

(56) References Cited

U.S. PATENT DOCUMENTS

| | | | | |
|---|---|---|---|---|
| 1,711,514 | A * | 5/1929 | Abrahams et al. | 381/343 |
| 2,832,844 | A * | 4/1958 | Matsuoka | 381/340 |
| 4,157,741 | A * | 6/1979 | Goldwater | 381/342 |
| 4,325,456 | A * | 4/1982 | Ureda | 181/159 |
| 4,525,604 | A | 6/1985 | Frye | |
| 6,064,745 | A * | 5/2000 | Avera | 381/343 |
| 8,036,408 | B2 | 10/2011 | Voishvillo | |
| 2005/0105753 | A1 * | 5/2005 | Manzini et al. | 381/343 |

* cited by examiner

*Primary Examiner* — Curtis Kuntz
*Assistant Examiner* — Ryan Robinson
(74) *Attorney, Agent, or Firm* — Allenman Hall McCoy Russell & Tuttle LLP

(57) ABSTRACT

A phasing plug for a compression driver includes a base portion and a hub portion. The base portion includes a first side, a second side, and a plurality of apertures extending between the first and second sides. The hub portion extends from the base portion along an axis. The hub portion includes an outer surface and a plurality of ribs disposed on the outer surface. A plurality of recesses are defined by the outer surface and respective pairs of adjacent ribs. At least one aperture fluidly communicates with at least one of the recesses.

26 Claims, 14 Drawing Sheets

PHASING PLUG FOR A COMPRESSION DRIVER

CROSS-REFERENCE TO RELATED APPLICATIONS

This application is a continuation and claims priority to U.S. application Ser. No. 11/317,654, filed on Dec. 22, 2005, titled PHASING PLUG FOR A COMPRESSION DRIVER, which application is incorporated by reference in this application in its entirety.

BACKGROUND OF THE INVENTION

1. Field of the Invention

This invention relates generally to electro-acoustical drivers and loudspeakers employing electro-acoustical drivers. More particularly, the invention relates to improved configurations for compression drivers.

2. Related Art

An electro-acoustical transducer or driver is utilized as a loudspeaker or as a component in a loudspeaker system to transform electrical signals into acoustical ones. The basic designs and components of various types of drivers are well-known and therefore need not be described in detail. Briefly, a driver receives electrical signals and converts the electrical signals to acoustic signals. The driver typically includes mechanical, electromechanical, and magnetic elements to effect this conversion. For example, the electrical signals may be directed through a circular voice coil that is attached to diaphragm and the voice coil positioned in an air gap with a radially oriented permanent magnetic field provided by a permanent magnet and steel elements of a magnet assembly. Due to the Lorenz force affecting the conductor of current positioned in the permanent magnetic field, the alternating current corresponding to electrical signals conveying audio signals actuates the voice coil to reciprocate back and forth in the air space and, correspondingly, move the diaphragm to which the coil is attached. The voice coil may be attached to a flexible diaphragm that is suspended by one or more supporting elements (e.g., a surround, spider, or the like) such that at least a portion of the diaphragm is permitted to move. Accordingly, the reciprocating voice coil actuates the diaphragm to likewise reciprocate and, consequently, produce acoustic signals that propagate as sound waves through a suitable fluid medium such as air. Pressure differences in the fluid medium associated with these waves are interpreted by a listener as sound. The sound waves may be characterized by their instantaneous spectrum and level.

The driver at its output side may be coupled to an acoustic waveguide, which is a structure that encloses the volume of medium into which sound waves are first received from the driver. The waveguide may be designed to increase the efficiency of the transducer and control the directivity of the propagating sound waves. The waveguide typically includes one open end coupled to the driver, and another open end or mouth downstream from the driver-side end. Sound waves produced by the driver propagate through the waveguide and are dispersed from the mouth to a listening area. The waveguide is often structured as a horn or other flared structure such that the interior defined by the waveguide expands or increases from the driver-side end to the mouth.

Electro-acoustical transducers or drivers may be characterized into two broad categories: direct-radiating types and compression types. A direct-radiating transducer produces sound waves and radiates these sound waves directly into open air (i.e., the environment ambient to the loudspeaker), whereas a compression driver first produces sound waves in a high-pressure enclosed volume, or compression chamber, before radiating the sound waves to the typically much lower-pressure open-air environment. The compression chamber is open to a structure commonly referred as a phasing plug that works as a connector between the compression chamber and the horn. The area of the entrance to the phasing plug is smaller than the area of the diaphragm. This provides increased efficiency compared to a direct-radiating loudspeaker. In a direct-radiating loudspeaker, the output mechanical impedance of the vibrating diaphragm is significantly higher than the radiation impedance that causes "generator" (diaphragm) and "load" (radiation impedance) mismatch. In a compression driver, the loading impedance (entrance to the phasing plug) is significantly higher than the open air radiation impedance. This produces much better matching between "generator" and "load" and increases the efficiency of the transducer. The relative advantages and disadvantages of direct-radiating drivers and compression drivers are well-known to persons skilled in the art. Generally, compression drivers are considered to be superior to direct-radiating drivers for generating high sound-pressure levels. The present disclosure is primarily directed to compression drivers.

As noted, a compression driver utilizes a compression chamber on the output side of the diaphragm to generate relatively higher-pressure sound energy prior to radiating the sound waves from the loudspeaker. Typically, a phasing plug is interposed between the diaphragm and the waveguide or horn portion of the loudspeaker, and is spaced from the diaphragm by a small distance (typically a fraction of a millimeter). Accordingly, the compression chamber is bounded on one side by the diaphragm and on the other side by the phasing plug. The phasing plug is typically perforated in some fashion. That is, the phasing plug includes apertures (i.e., passages or channels) that extend between the compression chamber and the waveguide or horn portion of the loudspeaker to provide acoustic pathways from the compression chamber to the waveguide. The cross-sectional area of the apertures is small in comparison to the effective area of the diaphragm, thereby providing air compression and increased sound pressure in the compression chamber.

The compression driver, characterized by having a phasing plug and a compression chamber, can provide a number of advantages if properly designed. These advantages may include increasing the efficiency with which the mechanical energy associated with the moving diaphragm is converted into acoustic energy. Decreasing the parasitic compliance of air in the compression chamber prevents undesired attenuation of high-frequency acoustic signals. Proper position of apertures in the phasing plug and the lengths of the passages provide delivering sound energy in phase from all parts of the diaphragm, suppressing or canceling high-frequency standing waves in the compression chamber, and reducing or eliminating undesired interfering cancellations in the propagating sound waves.

It is well-recognized by persons skilled in the art that an ongoing need exists for providing improved designs for compression drivers so as to more fully attain their advantages such as high-frequency efficiency, while ameliorating their disadvantages such as detrimental acoustical non-linear effects, irregularity of frequency response, and limited frequency range.

SUMMARY

According to one implementation, a phasing plug for a compression driver is provided. The phasing plug comprises a base portion and a hub portion. The base portion includes a first side, a second side, and a plurality of apertures extending between the first and second sides. The hub portion extends from the base portion along an axis. The hub portion includes an outer surface and a plurality of ribs disposed on the outer surface. A plurality of recesses is defined by the outer surface and respective pairs of adjacent ribs. At least one aperture fluidly communicates with at least one of the recesses.

According to another implementation, a phasing plug for a compression driver is provided. The phasing plug comprises a housing, a base portion, and a hub portion. The housing includes an inner surface defining an interior and an outlet. The base portion includes a first side, an opposing second side generally facing the interior, a plurality of apertures extending between the first and second sides, and a plurality of bridge sections. Each bridge section is interposed between a corresponding pair of adjacent apertures. The hub portion extends from the base portion into the housing along an axis. The hub portion includes an outer surface disposed coaxially about the axis and a plurality of ribs extending from the outer surface. Each rib includes a first rib end disposed at a corresponding bridge section and a second rib end disposed at a distance from the first rib end. A plurality of recesses are respectively defined between pairs of adjacent ribs. Each aperture fluidly communicates with at least one recess. The inner surface and the outer surface cooperatively define a waveguide generally extending from the apertures to the outlet. At least a portion of the waveguide proximate to the apertures is further defined by the recesses.

According to another implementation, a compression driver is provided. The compression driver includes a housing including an inner surface at least partially defining an interior of the housing, a phasing plug disposed in the housing, and a compression chamber defined between the diaphragm and the phasing plug. The phasing plug includes a plurality of apertures providing a plurality of respective fluid passages from the compression chamber to the housing interior, a hub portion disposed in the interior and including an outer surface, a plurality of ribs protruding outwardly from the outer surface, and a plurality of recesses interposed between respective pairs of adjacent ribs. Each rib fluidly communicating with at least one of the apertures.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

In general, the term "communicate" (for example, a first component "communicates with" or "is in communication with" a second component) is used in the present disclosure to indicate a structural, functional, mechanical, electrical, optical, magnetic, ionic or fluidic relationship between two or more components (or elements, features, or the like). As such, the fact that one component is said to communicate with a second component is not intended to exclude the possibility that additional components may be present between, and/or operatively associated or engaged with, the first and second components.

Examples of implementations of the present subject matter will now be described with reference to FIGS. 1-14.

Figure 1:
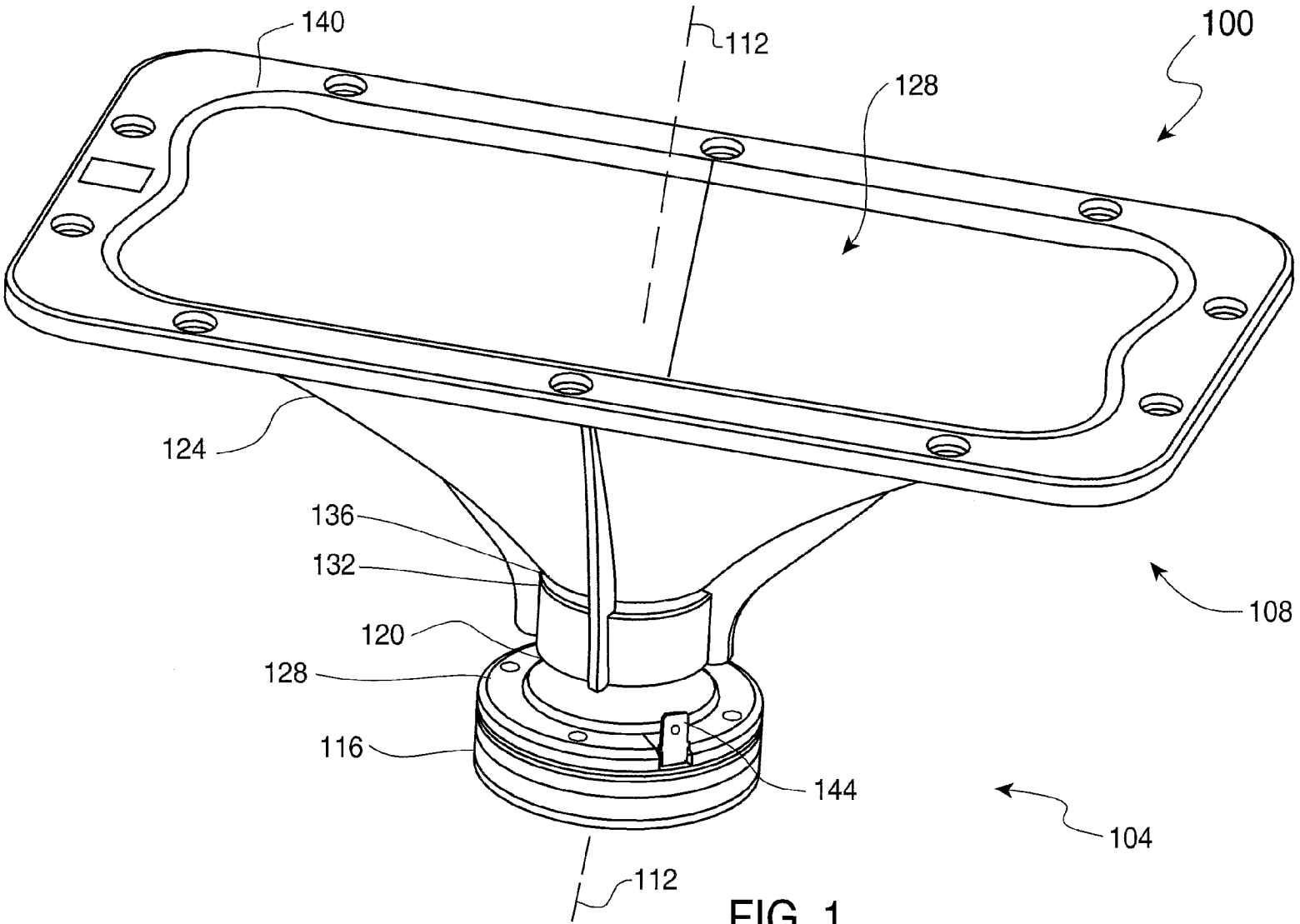
FIG. 1 is a perspective view of an example of a horn loudspeaker in which a compression driver as described below may be implemented.

FIG. 1 illustrates a perspective view of an example of a horn loudspeaker 100 in which a compression driver as described below may be implemented. The loudspeaker 100 includes an electro-acoustical transducer section 104. In some implementations, the loudspeaker 100 may also include a waveguide or horn 108. The transducer section 104 and horn 108 are generally disposed about a central axis 112. The transducer section 104 may include a rear section 116 and a housing or adapter 120. The rear section 116 may be coupled to the housing 120 by any suitable means. The rear section 116 and housing 120 may enclose components for realizing a driver of the compression type, an example of which is described below. The horn 108 may include a horn structure 124 such as one or more walls that enclose an interior 128 of the horn 108. As illustrated, the horn structure 124 may be flared or tapered outwardly from the central axis 112 to provide an expanding cross-sectional area through which sound waves propagate. The housing 120 generally includes a first or input end 128 and a second or output end 132. Likewise, the horn 108 generally includes a first or input end 136 and a second or output end commonly referred to as a mouth 140. The output end 132 of the housing 120 may be coupled to the input end 136 of the horn 108 by any suitable means. Generally, the loudspeaker 100 receives an input of electrical signals at an appropriate connection such as contacts 144 provided by the transducer section 104 (such as may be located at the rear section 116) and converts the electrical signals into acoustic signals according to mechanisms briefly summarized above and readily appreciated by persons skilled in the art. The acoustic signals propagate through the interior of the housing 120 and horn 108 and exit the loudspeaker 100 at the mouth 140 of the horn 108.

As a general matter, the loudspeaker 100 may be operated in any suitable listening environment such as, for example, the room of a home, a theater, or a large indoor or outdoor arena. Moreover, the loudspeaker 100 may be sized to process any desired range of the audio frequency band, such as the high-frequency range (generally 2 kHz-20 kHz) typically produced by tweeters, the midrange (generally 200 Hz-5 kHz) typically produced by midrange drivers, and the low-frequency range (generally 20 Hz-200 Hz) typically produced by woofers. As appreciated by persons skilled in the art, loudspeakers 100 of the horn driver-type are particularly advantageous when utilized to process relatively high frequencies (i.e., midrange to high range), and compression drivers are typically more efficient at higher frequencies than non-compression driver configurations such as the direct-radiating type.

Figure 2:
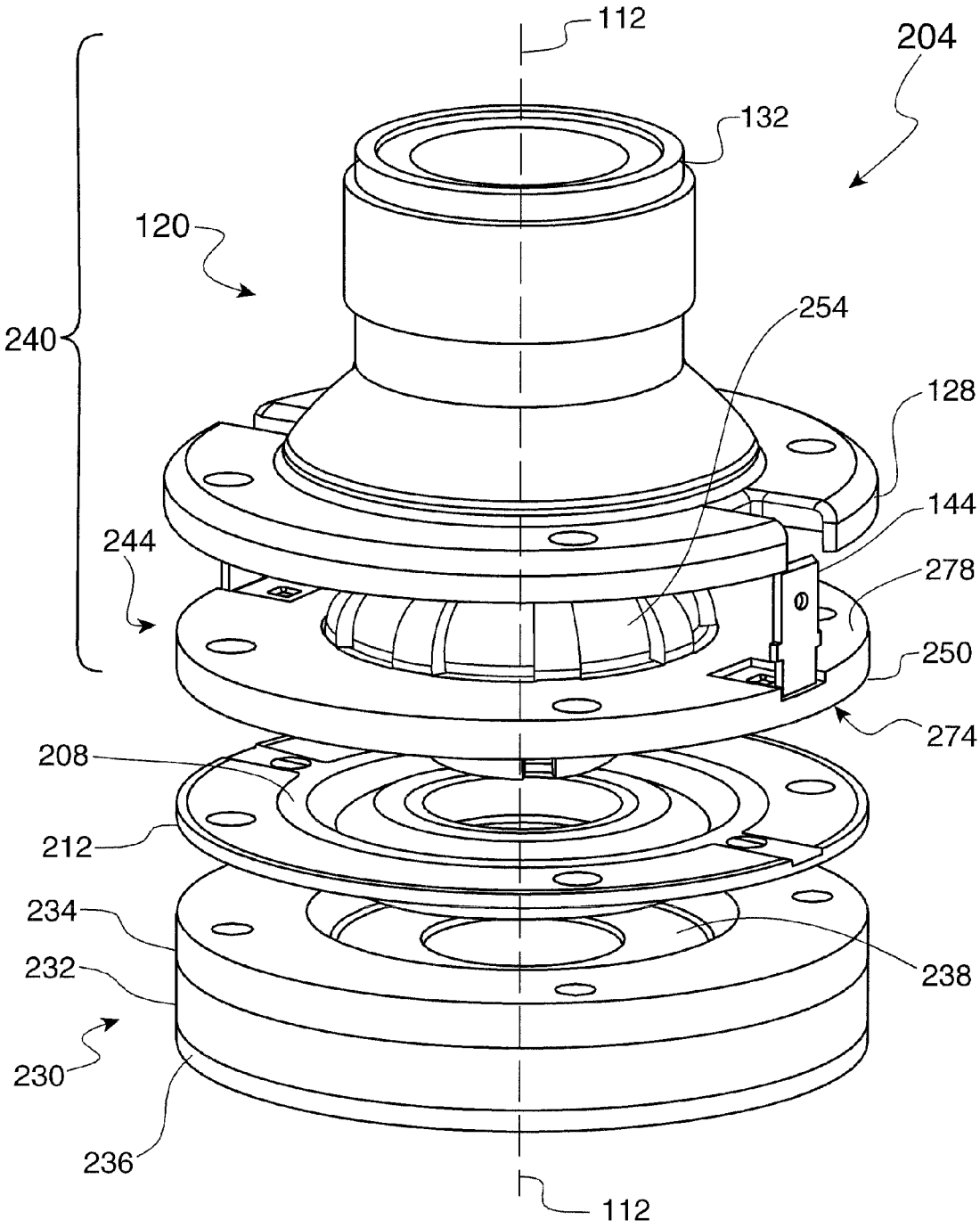
FIG. 2 is an exploded perspective view of a compression driver that may be provided with the loudspeaker of FIG. 1.

FIG. 2 is an exploded perspective view of an example of a compression driver 204 and associated components and features that may be provided as parts of the transducer section 104 (FIG. 1) of the horn loudspeaker 100. The compression driver 204 may include a flexible diaphragm 208, one or more suspension members 212 for supporting the diaphragm 208 while enabling the diaphragm 208 to oscillate, and a magnet assembly 230 that may comprise an annular permanent magnet 232, an annular top plate 234, and a back plate 236 that includes a centrally disposed annular pole piece 238, for providing a permanent magnetic field in the gap (see FIG. 3 and related description below) between the pole piece 238 and an inside surface of the annular top plate 234 for electrodynamic coupling with a voice coil (described below and illustrated in FIG. 3). In the example illustrated in FIG. 2, the diaphragm 208 is configured as an annular ring that is disposed coaxially with the central axis 112. In other implementations, however, the diaphragm 208 may have other suitable configurations such as a dome or a cone. The compression driver 204 may also include a phasing plug assembly 240 that comprises the housing 120 and a phasing plug 244 generally disposed within the housing 120. The body of the phasing plug 244 may include a base portion 250 and a central or hub portion 254, both of which are coaxially disposed about the central axis 112. The hub portion 254 may also be referred to as a bullet. The base portion 250 generally includes a first or input side 274 generally facing the diaphragm 208, and an opposing second or output side 278 generally facing the interior of the housing 120. The base portion 250 may further include one or more apertures (described below and illustrated in FIGS. 4-6 and 9) that extend as channels or passages through the thickness of the base portion 250 from the input side 274 to the output side 278.

Figure 3:
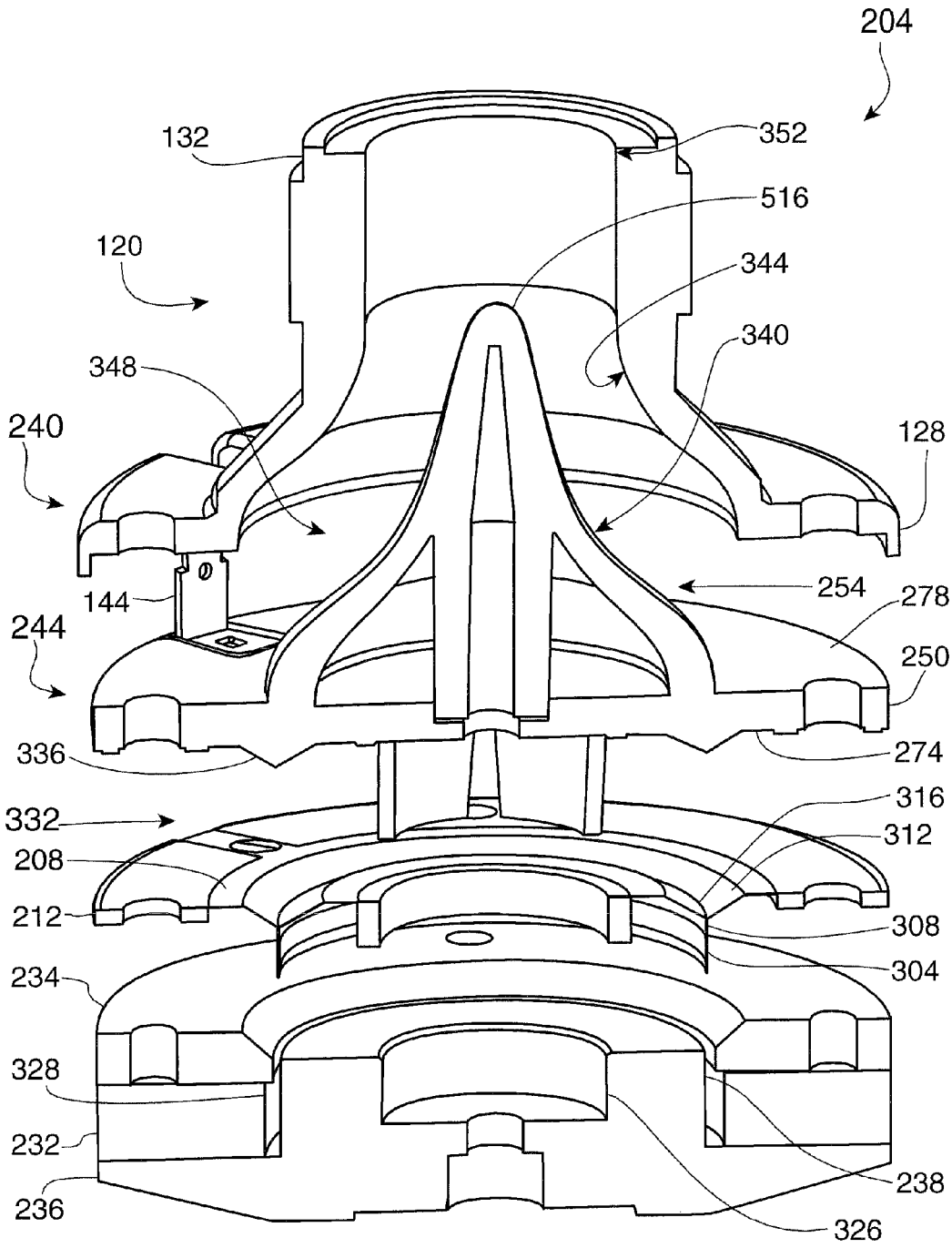
FIG. 3 is an exploded cross-sectional view of the compression driver illustrated in FIG. 2.

FIG. 3 is an exploded cross-sectional view of the compression driver 204 illustrating additional components and features that may be provided. The compression driver 204 additionally includes a magnet or voice coil 304 for producing the movement of the flexible portion of the diaphragm 208 and a structural member such as a coil former 308 for supporting the voice coil 304. The diaphragm 208 may include a profiled section such as a V-shaped section 312 having a circular apex 316 coaxial with the central axis 112. The voice coil 304 or the former 308 may be attached to the diaphragm 208 at the apex 316 to facilitate actuation of the diaphragm 208 by the voice coil 304. The compression driver 204 may also include the afore-mentioned annular top plate 234 and back plate 236. The pole piece 238, which may be integrated with the back plate 236, may include a central bore 326. The top plate 234 and outer magnet 232 on the one side and the pole piece 238 on the other side cooperatively define a magnetic or air gap 328. In the assembled form of the compression driver 204 (see FIG. 9), the voice coil 304 and coil former 308 are disposed in this gap 328 such that the voice coil 304 is immersed in a magnetic field, and the gap 328 provides axial spacing through which the voice coil 304 may oscillate. It can be seen that upon assembly of the compression driver 204, a compression chamber is defined in a spacing 332 between the diaphragm 208 and the input side 274 of the base portion 250 (see also FIG. 9 and related description below). In practice, the height of the compression chamber (i.e., the distance between the diaphragm 208 and the input side 274 of the base portion 250) may be quite small (e.g., approximately 0.5 mm or less) such that the volume of the compression chamber is also small. In implementations where the diaphragm 208 includes a V-shaped section 312, the base portion 250 at the input side 274 may also include a complementary V-shaped section 336 (or other type of profiled section) positioned in general alignment with the V-shaped section 312 to maintain the small volume of the compression chamber.

As described in more detail below, the hub portion 254 of the phasing plug 244 generally includes one or more outer surfaces 340 and the housing 120 includes an inner surface 344. After assembly of the phasing plug assembly 240, the outer surface 340 and inner surface 344 cooperatively define a waveguide 348 for the propagation of sound waves through the phasing plug assembly 240. The waveguide 348 terminates at an outlet 352 of the phasing plug assembly 240 (which, in the present example, is defined primarily by the structure of the housing 120 at the output end 132) such that the waveguide 348 fluidly communicates with the interior 128 of the horn 108 if provided (FIG. 1). The horn 108 may also be considered to be a waveguide in that sound energy radiates through the horn 108 and is constrained by the structure 124 of the horn 108 that shapes its interior 128.

Figure 4:
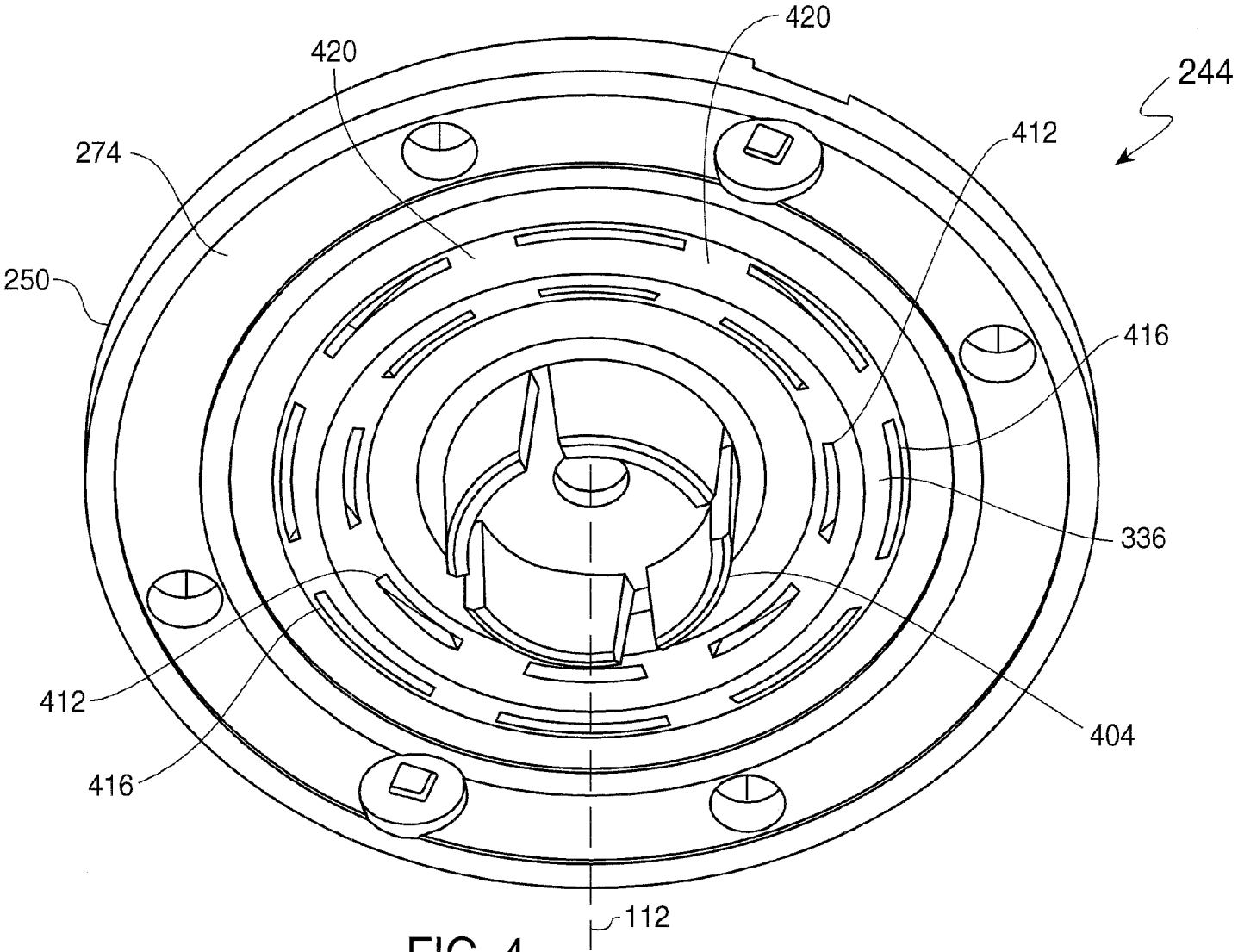
FIG. 4 is a perspective view of an example of a phasing plug that may be utilized in the compression driver illustrated in FIGS. 2 and 3, specifically from the perspective of the input side of the phasing plug.
Figure 9:
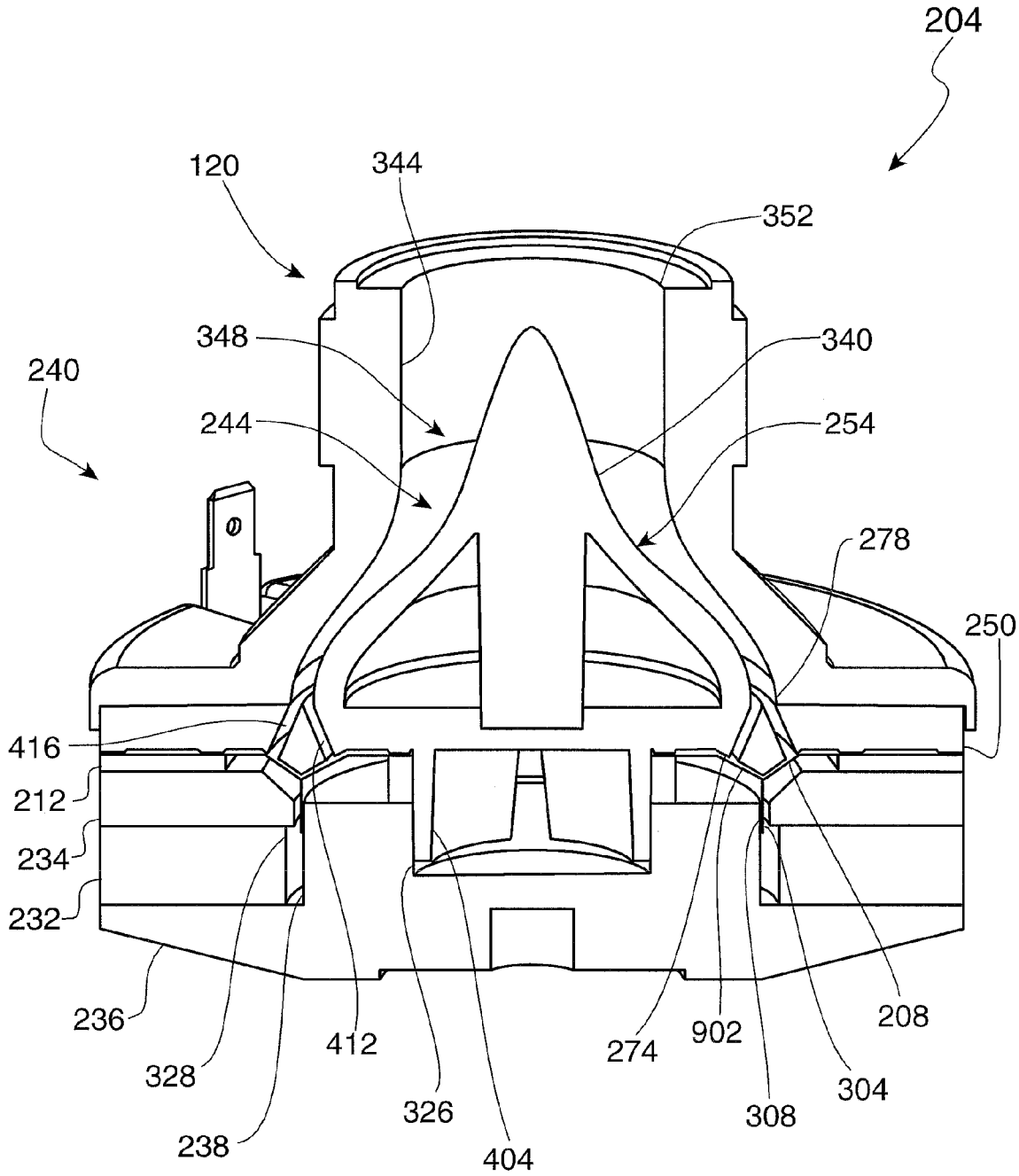
FIG. 9 is a perspective cross-sectional view of the compression driver in assembled form.

FIG. 4 is a perspective view of the phasing plug 244 that may be located in the transducer section 104 of the loudspeaker 100 (FIG. 1) and assembled with the housing 120 as shown in FIGS. 2 and 3. Specifically, FIG. 4 illustrates the phasing plug 244 from the perspective of its input side 274, i.e., the side on which the diaphragm 208 and compression chamber of the compression driver 204 may be located (see FIGS. 2 and 3). The phasing plug 244 may include a mounting feature 404 on the input side 274 that depends downwardly from the base portion 250. The mounting feature 404 may have any configuration suitable for coupling the phasing plug 244 to the rear section 116 of the loudspeaker 100 (FIG. 1). In the illustrated example, the mounting feature 404 is provided in the form of a segmented cylinder that is adapted to be press-fitted into the central bore 326 formed in the pole piece 238 or back plate 236 (FIG. 3; see also FIG. 9). As illustrated in FIG. 4, the base portion 250 of the phasing plug 244 may be generally circular or may have any other suitable geometry.

As additionally illustrated in FIG. 4 and as previously described, one or more apertures may be formed through the thickness of the base portion 250 through which sound energy may travel from the input side 274 to the opposing output side 278 (FIGS. 2 and 3) of the base portion 250. For example, the base portion 250 may include one or more first or inner apertures 412 and one or more second or outer apertures 416. When more than one aperture 412 or 416 is employed, the resulting plurality of apertures 412 or 416 may be circumferentially spaced from each other relative to the central axis 112. Moreover, each aperture 412 or 416 may have a dominant dimension (e.g., length, width, etc.) in one direction such that each aperture 412 or 416 may be characterized as a slot or slit. The dominant dimension may be arcuate such that each aperture 412 or 416 may be formed as a circular segment. In other implementations, the apertures 412 or 416 may have a dominant dimension in the radial direction relative to the central axis 112, in which case the apertures 412 or 416 may be characterized as radial slots. In still other implementations, no one dimension of the apertures 412 or 416 may be substantially dominant, such that the apertures 412 or 416 are more rectilinear-shaped as compared to the implementation illustrated in FIG. 4 (see, e.g., FIG. 12).

Moreover, as specifically illustrated in the example provided in FIG. 4, some or all apertures of the phasing plug 244 may be grouped in one or more segmented, concentric circles relative to the central axis 112. For example, one circumferential set of apertures 412 may be located at a first radius from the central axis 112, another circumferential set of apertures 416 may be located at a second, greater radius from the central axis 112, and additional apertures (not shown) may be located at different (greater and/or lesser) radii. Some or all of the apertures 412 and 416 may be located at the V-shaped section 336 of the input side 278 of the base portion 250. As also illustrated by way of example in FIG. 4, the respective angles at which the apertures 412 and 416 are oriented at the sides of the V-shaped section 336 may be continued through the thickness of the base portion 250, such that the apertures 412 and 416 (and hence the air paths defined by the apertures 412 and 416) converge towards each other as they approach the side of the base portion 250 opposite to the input side 274 (see FIG. 9). Corresponding pairs of inner apertures 412 and outer apertures 416 may be circumferentially separated by solid bridge sections 420 of the base portion 250. The bridge sections 420 may also serve to hold separate parts of the phasing plug 244 together and thus provide mechanical integrity for the phasing plug 244.

As in the case of any compression driver, an important parameter of the compression driver 204 illustrated in this disclosure is its compression ratio, which is determined from the relationship between the effective area of the diaphragm 208 (FIGS. 2 and 3) and the effective area of the entrance into the phasing plug 244. In the implementation illustrated by way of example in FIGS. 2 and 3, the effective area of the diaphragm 208 is the portion of the diaphragm 208 that serves as a boundary of, and hence at least partially defines, the compression chamber. As illustrated in FIG. 4, the effective area of the entrance into the phasing plug 244 is the total cross-sectional area of all apertures 412 and 416 of the base portion 250 at the input side 274. The compression ratio affects the efficiency of the compression driver 204 and influences the shape of the frequency response. Therefore, the dimensions of the apertures 412 and 416 of the phasing plug 244 and the dimensions of the bridge sections 420 between the apertures 412 and 416 are variables that control the compression ratio.

In addition, the radial positions of the apertures 412 and 416 relative to the central axis 112 determine the shape of the frequency response of the compression driver 204 at high frequencies, because the apertures 412 and 416 may suppress the high-frequency standing waves that may occur in a radial direction within the compression chamber. The use of several concentrically positioned apertures 412 and 416 provides shorter paths for sound waves traveling from the peripheral, circumferential boundaries of the compression chamber to the nearest apertures 412 or 416. As the height of the compression chamber may be merely a fraction of a millimeter, viscous resistive losses in the air may affect frequency response if the path of a sound wave in a radial direction is long. Accordingly, the use of several apertures 412 and 416 as illustrated in FIG. 4 shortens the radial path and provides a favorable condition for the propagation of sound waves without significant losses. Furthermore, the use of several apertures 412 and 416 may be desirable because a single aperture may not be sufficient to suppress undesirable resonances.

In addition, while the size (i.e., dimensions) of the apertures 412 and 416 should be selected so as to attain the desired compression ratio, the apertures 412 and 416—particularly when shaped as slots or other narrow shapes—should not be so narrow as to adversely affect maintaining proper, repeatable tolerances during manufacture. Moreover, the use of excessively narrow or restrictive apertures 412 and 416 may adversely affect the reproduction of high-frequency audio signals due to the introduction of viscous, resistive losses. Therefore, all such factors should be weighed in sizing the apertures 412 and 416. In some implementations, the size of the apertures 412 and 416 is optimized by maintaining a width (i.e., the long dimension) of, for instance, approximately 1 mm or greater. As noted previously, the width of the apertures 412 and 416 and thus the compression ratio may be controlled by controlling the width and number of the bridge sections 420 between the apertures 412 and 416.

Figure 5:
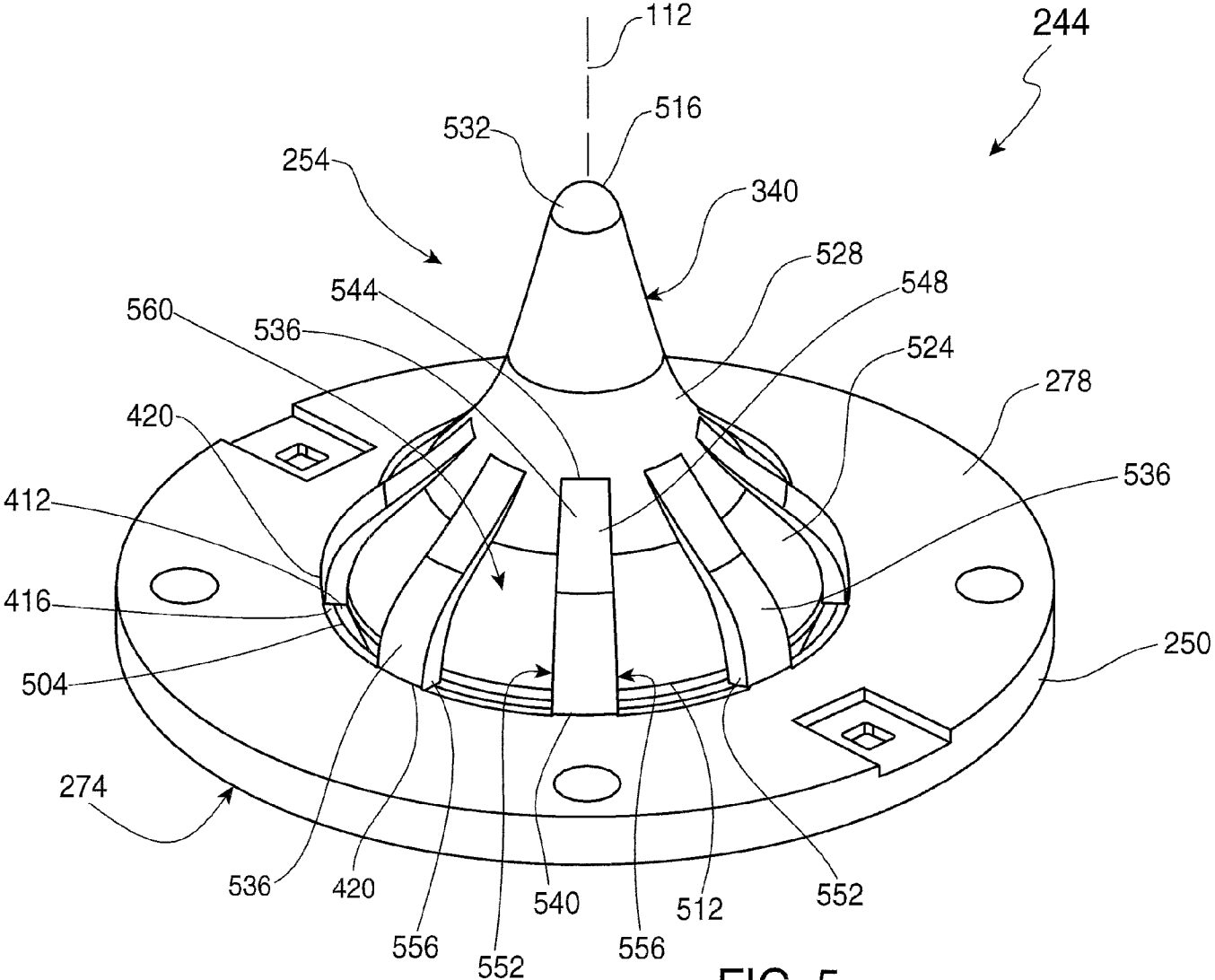
FIG. 5 is a perspective view of the phasing plug illustrated in FIG. 4, specifically from the perspective of the output side of the phasing plug.

FIG. 5 is a perspective view of the phasing plug 244 from the perspective of the output side 278 of the phasing plug 244 on which the horn 108 (FIG. 1) may be located, i.e., the side of the base portion 250 opposite to the input side 274 where sound waves are produced. By way of example in FIG. 5, the apertures 412 and 416 may converge toward each other until they terminate at the output side 278, where each corresponding pair of inner apertures 282 and outer apertures 312 is separated by an edge or landing 504. Like the apertures 412 and 416, each edge 504 may be arcuate such that the edges 504 comprise circular segments. On the output side 278, adjacent edges 504 as well as corresponding pairs of inner apertures 282 and outer apertures 312 may be circumferentially separated by the bridge sections 420 of the base portion 250.

As also illustrated in FIG. 5 and as noted previously, the phasing plug 244 may include a central or hub portion 254, which may also be referred to as a bullet. The hub portion 254 may be integrally formed with the base portion 250 in a suitable fabrication process, or may be attached to the base portion 250 by any suitable means. The hub portion 254 has a first or proximal end 512 disposed proximate to the base portion 250 and a second or distal end 516 disposed at a distance from the base portion 250 along the central axis 112. From the perspective of FIG. 5, the hub portion 254 extends upwardly from the base portion 250 generally along the central axis 112 from the first end 512 to the second end 516. As previously noted, the outer profile of the hub portion 254, or the radial profile relative to the central axis 112, may be defined by one or more outer surfaces 340. In some implementations, the hub portion 254 is axisymmetrical about the central axis 112 and its cross-section perpendicular to the central axis 112 is generally circular, such that the outer profile of the hub portion 254 may be defined essentially by a single outer surface 340 swept about the central axis 112. The outer surface 340 may taper in the direction along the central axis 112 from the first end 512 to the second end 516, such that the radius of the cross-section of the hub portion 254 relative to the central axis 112 decreases in this direction as illustrated in FIG. 5. In such an implementation, the radius of the outer surface 340 at the first end 512 is greater than the radius of the outer surface 340 at the second end 516. Moreover, in some implementations such as illustrated in FIG. 5, the radius of the outer surface 340 at the first end 512 is the maximum radius and the radius of the outer surface 340 at the second end 516 is the minimum radius. In some implementations, the second end 516 terminates at a point or edge, while in other implementations the second end 516 is rounded or domed. In either case, the distal-most portion of the second end 516 may be an apex at which the radius is essentially zero, or coincident with the central axis 112.

In some implementations such as illustrated in FIG. 5, the hub portion 254 (or at least its outer surface 340) may be considered as including two or more sections, with adjacent sections preferably transitioning into each other smoothly without any sharp features or discontinuities. In the example given in FIG. 5, the hub portion 254 includes a first section 524 that transitions into a second section 528. The first section 524 may be convex, or curve (or bulge) outwardly, relative to the central axis 112, and the second section 528 may be concave, or curve (or bulge) inwardly, relative to the central axis 112. The second end 516 of the hub portion 254, if rounded or domed, may be considered a third section 532, which may be convex relative to the central axis 112. In some implementations, the outer surface 340 of the hub portion 254 may be characterized as being shaped as a "candy kiss." One function of the hub portion 254 is to partially define the enclosed area or waveguide 348 (FIG. 3) through which sound energy exiting from apertures 412 and 416 travels. Accordingly, as illustrated in FIG. 5, the radius of the outer surface 340 of the hub portion 254 at the first end 512 is less than or approximately equal to the radius of the innermost circumferential group of apertures 412.

As further illustrated in FIG. 5, the hub portion 254 may include a plurality of protruding elements such as ribs 536 disposed on the outer surface 340. The ribs 536 may extend generally in a resultant direction from the first end 512 of the hub portion 254 toward the second end 516, and may traverse over a portion of the outer surface 340 as illustrated or may traverse the entire outer surface 340 up to or near the second end 516. Each rib 536 includes a first or proximal end 540 disposed proximate to the base portion 250 and a second or distal end 544 disposed at a distance from the base portion 250 along the central axis 112. In some implementations, as illustrated in FIG. 5, the first end 540 of each rib 536 begins at or near a corresponding one of the bridge sections 420 of the base portion 250, such that each pair of inner apertures 412 and outer apertures 416 is interposed between adjacent first ends 540. Each rib 536 may protrude radially outwardly from the outer surface 340 of the hub portion 254 to an outer surface 548 of the rib 536, and hence each rib 536 may include two opposing side walls 552 and 556 on either side of its outer surface 548. The circumferential width of each rib 536 (e.g., the width of each outer surface 548) may be uniform or substantially uniform along its length as illustrated in FIG. 5, or this width may vary or taper. The side walls 552 and 556 of each rib 536 determine the radial thickness or height of the rib 536 between the outer surface 340 of the hub portion 254 and the outer surface 548 of the rib 536, i.e., the amount by which the rib 536 protrudes from the outer surface 340 of the hub portion 254 at any given location. This radial thickness of the rib 536 may vary or taper generally in the direction along the central axis 112 from the first end 540 to the second end 544 of each rib 536, such that the radial thickness decreases in this direction as illustrated in FIG. 5. In such an implementation, the radial thickness of each rib 536 at the first end 540 is greater than the radial thickness at the second end 544. Moreover, in some implementations such as illustrated in FIG. 5, the radial thickness of each rib 536 at the first end 540 is the maximum radial thickness and the radial thickness of each rib 536 at the second end 544 is the minimum radial thickness. In some implementations, the second end 544 of each rib 536 is flush or substantially flush with the outer surface 340 of the hub portion 254, such that the radial thickness of each rib 536 at the second end 544 is reduced to zero or approximately zero and each rib 536 gradually merges into the outer surface 340 of the hub portion 254. The outer profile of each rib 536, defined generally by the outer surface 548, may be shaped similarly to the outer profile of the hub portion 254 or otherwise follow the outer profile of the hub portion 254. Accordingly, in some implementations such as the example illustrated in FIG. 5, the portion of each rib 536 immediately adjacent to the outwardly bulging first section 524 of the hub portion 254 may also bulge outwardly.

In the example illustrated in FIG. 5, the side walls 556 and 552 that face each other between any two adjacent ribs 536, and the outer surface 340 of the hub portion 254 between the same two adjacent ribs 536, cooperatively define a pocket or recess 560 that begins at the base portion 250 where the apertures 412 and 416 are located and ends generally at the second ends 544 of the adjacent ribs 536. Accordingly, in this example, a plurality of pockets or recesses 560 are defined between each pair of adjacent ribs 536, with the number of recesses 560 corresponding to the number of apertures 412 or 416 or pairs of inner apertures 412 and outer apertures 416. Each recess 560 is defined in part by a circumferential width or spacing between adjacent ribs 536. As illustrated in FIG. 5, due to the tapering outer profile of the hub portion 254, the circumferential width of each recess 560 may likewise taper in a decreasing manner generally in the axial direction from the first ends 540 of the ribs 536 to the second ends 544. It can be seen that when the phasing plug 244 is assembled with the housing 120 as shown, for example, in FIG. 3, the recesses 560 may be considered as being part of the resulting waveguide 348, with the recesses 560 beginning at the apertures 412 and 416 on the output side 278 of the phasing plug 244 and transitioning into the remaining portion of the waveguide 348. As discussed further below, this configuration advantageously provides a continuous, gradual area of expansion for the propagation of sound waves.

Figure 6:
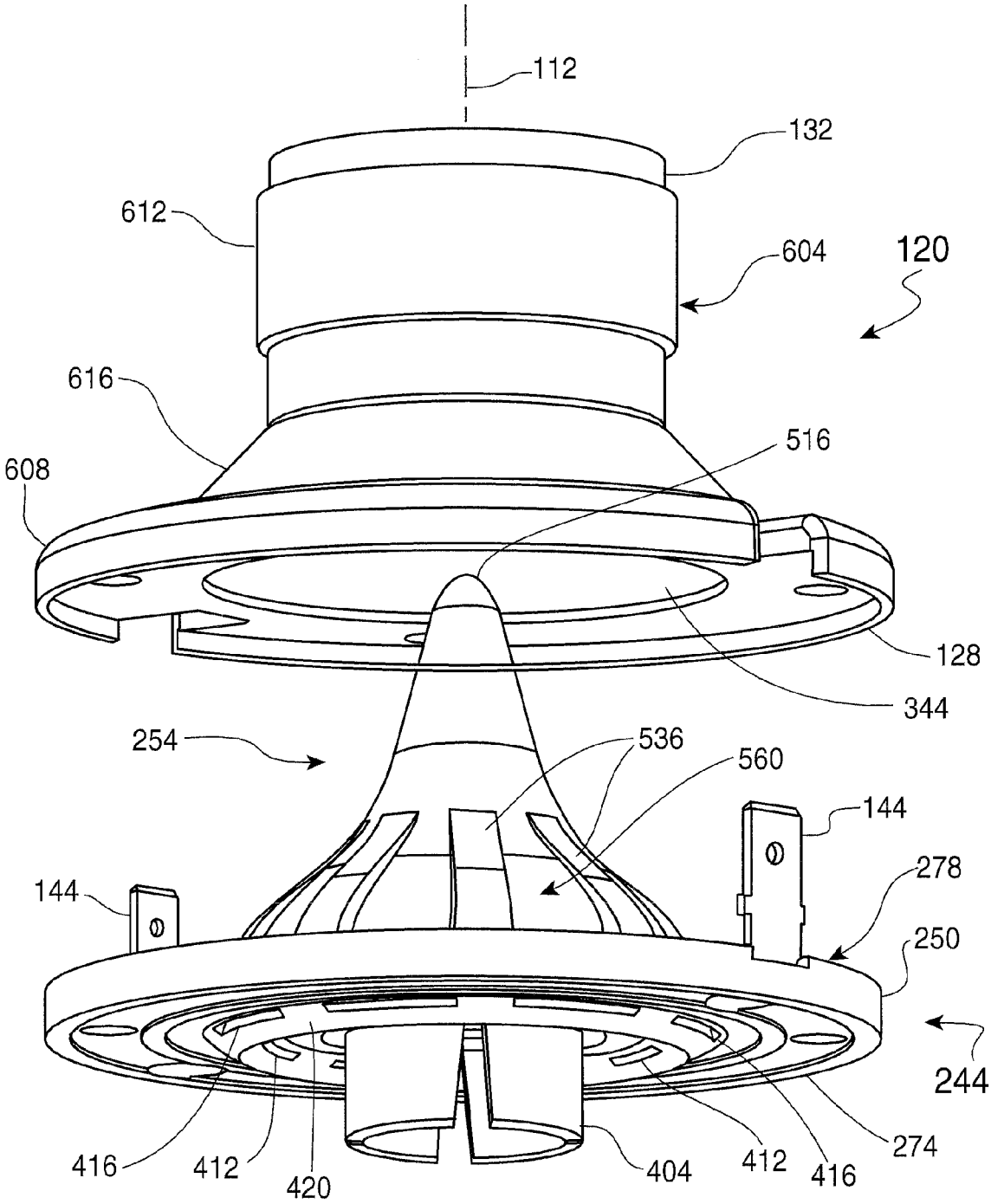
FIG. 6 is a perspective, exploded view of the phasing plug and an example of an adapter or housing prior to assembly of the phasing plug with the housing.

FIG. 6 is a perspective exploded view illustrating the phasing plug 244 in axial alignment with the housing 120 prior to assembly. As previously noted, the housing 120 generally includes an input end 128 that in assembly is located proximate to the base portion 250 of the phasing plug 244, and an output end 132 that is disposed at a distance from the first end 128 along the central axis 112. In addition to the previously noted inside surface 344, the housing 120 may include an outside surface 604, a flange portion 608, an upper portion 612, and a generally frustoconical intermediate portion 616 interposed between the flange portion 608 and the upper portion 612. The upper portion 612 may be generally cylindrical as illustrated in this example. The flange portion 608 may be adapted to fit onto, and wholly or partially enclose, the base portion 250 of the phasing plug 244. The inside surface 344 encloses an interior of the housing 120 to form a waveguide 348 as illustrated in FIG. 3. The inside surface 344 may be shaped to provide the waveguide 348 with an expanding cross-sectional area for sound propagation. The inside surface 344 may be shaped to accommodate a typical implementation in which apertures such as apertures 412 and 416 are located at a diameter relative to the central axis 112 that is greater than the diameter of the driver exit at the output end 132.

Figure 7:
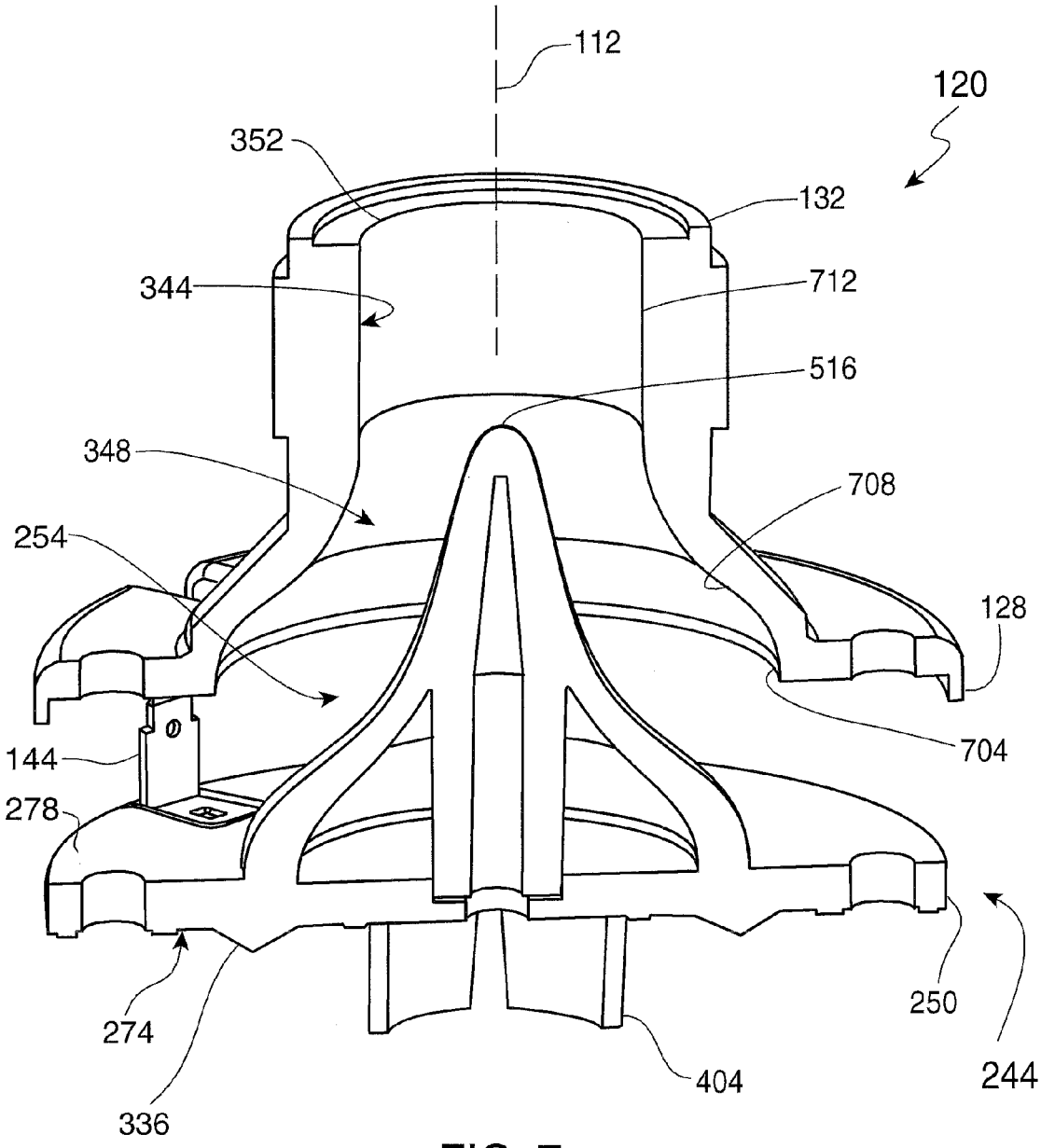
FIG. 7 is a perspective, exploded view in cross-section of the phasing plug and adapter illustrated in FIG. 6.

FIG. 7 is a cut-away exploded view illustrating the phasing plug 244 in axial alignment with the housing 120 prior to assembly. In this example, the inside surface 344 of the housing 120 may include a base or entrance section 704 at the first end 128. The base section 704 transitions to a tapered section 708, and the tapered section 708 in turn transitions to an upper section 712. The upper section 712 may be cylindrical or substantially cylindrical as illustrated in this example, or may have another suitable profile such as conical. The inside surface 344 in the upper section 712 terminates at the second end 132 of the housing 120, where the inside surface 344 defines the outlet 352 of the housing 120. To accommodate the insertion of the hub portion 254 of the phasing plug 244 into the interior of the housing 120 and to establish the beginning of the waveguide 348, the radius of the inside surface 344 of the housing 120 at its entrance section 704 relative to the central axis 112 is greater than the radius of the ribs 536 (FIGS. 5 and 6) of the hub portion 254 of the phasing plug 244 and is large enough to enclose all apertures 412 and 416 (FIG. 5) on the output side 278 of the phasing plug 244. The tapered section 708 of the inside surface 344 of the housing 120 may be tapered generally in the direction from the first end 128 toward the second end 132, such that the radius of the inside surface 344 in the tapered section 708 relative to the central axis 112 decreases along this direction. The radius of the inside surface 344 of the housing 120 in the upper section 712 may be uniform or substantially uniform.

Figure 8:
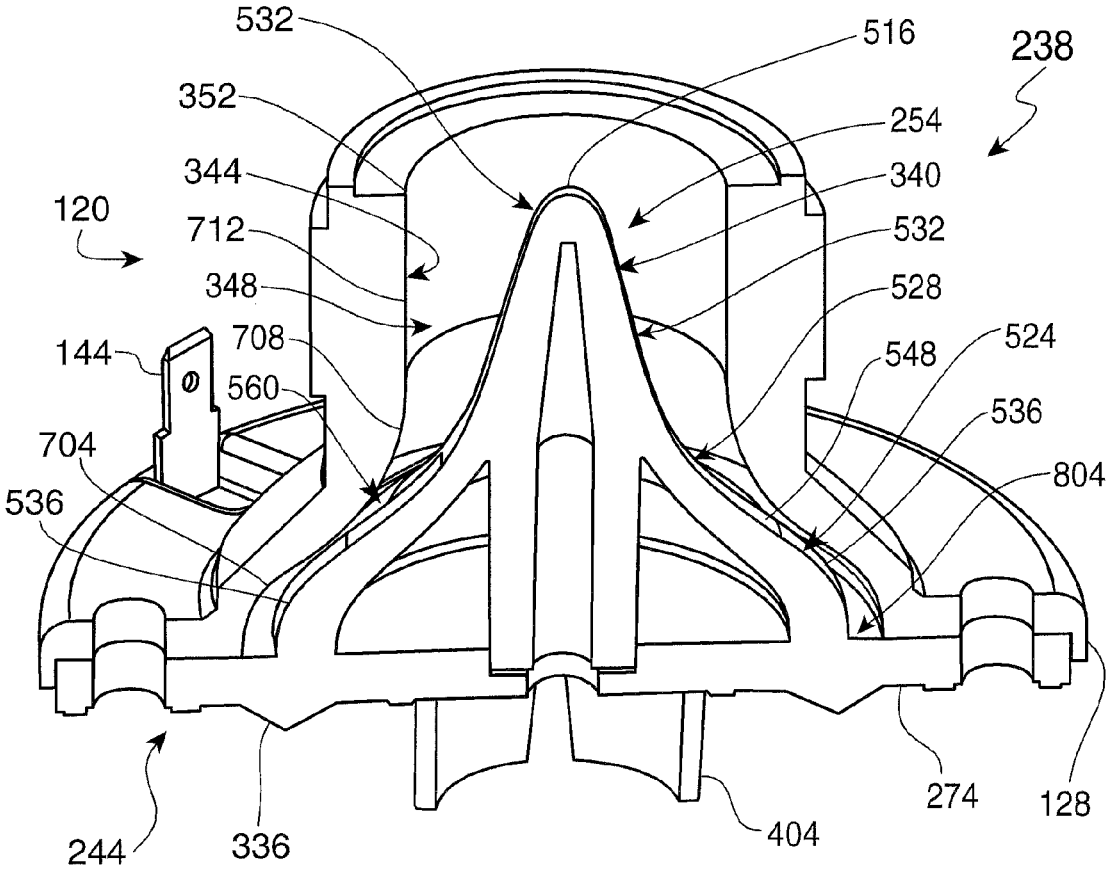
FIG. 8 is a perspective cross-sectional view of the phasing plug and adapter illustrated in FIGS. 6 and 7 after assembly.

FIG. 8 is a cut-away view illustrating the housing 120 assembled concentrically with the phasing plug 244 to form an implementation of the phasing plug assembly 240. When so assembled, the inside surface 344 of the housing 120 and the respective outer surfaces 340 and 548 of the hub portion 254 and ribs 536 cooperatively define the waveguide 348 of the phasing plug assembly 240 for propagating sound waves emanating from the exit sides of the apertures 412 and 416 (FIG. 5) of the phasing plug 244. From the perspective of FIG. 8, the exit sides of the apertures 412 and 416 of the phasing plug 244 are located at the planar elevation or level generally indicated by an arrow 804, which also designates the beginning or input end of the waveguide 348. That is, the input end 804 of the waveguide 348 is an annulus of relatively small cross-sectional area. In the example illustrated in FIG. 8, it can be seen that the curves defining the various sections of the outer surface 340 of the hub portion 254 (e.g., the first section 524, second section 528, and third section 532), as well as the outer surfaces 548 of the ribs 536, may be different than the curves defining the various sections of the inside surface 344 of the housing 120 (e.g., the base section 704, tapered section 708, and upper section 712). The respective cross-sectional profiles of the outer surfaces 340 and 548 of the hub portion 254 and ribs 536 and the inside surface 344 of the housing 120 may be configured such that cross-sectional area (orthogonal to the central axis 112) of the resulting waveguide 348 exhibits a progressive expansion for the propagation of sound waves. The waveguide 348 may be considered as ending at the outlet 352, at which the cross-sectional area of the waveguide 348 may be a maximum. The cross-sectional area of the waveguide 348 may be annular up to the end 516 of the hub portion 254. As previously noted in conjunction with the loudspeaker 100 illustrated in FIG. 1, the waveguide 348 may effectively be extended through the use of a horn 108.

FIG. 9 is a perspective cross-sectional view of the compression driver 204 in assembled form. An annular compression chamber 902 is defined between the diaphragm 208 and the input side 274 of the phasing plug 244. As previously noted, the spacing between the diaphragm 208 and the input side 274 of the phasing plug 244 is typically small (e.g., approximately 0.5 mm or less) such that the volume of the compression chamber 902 is likewise small. FIG. 9 illustrates the pathways through which sound may travel in the compression driver 204. As can be appreciated by persons skilled in the art, the actuation of the diaphragm 208 generates high sound-pressure acoustical signals within the compression chamber 902, and the signals travel as sound waves through the base portion 250 via the apertures 412 and 416 that provide passages from the input side 274 to the output side 278. From the apertures 412 and 416, the sound waves enter and radiate through the waveguide 348 of the phasing plug assembly 240 to the outlet 352. If a horn 108 (FIG. 1) is provided, the sound waves travel through the interior 128 of horn 108, which effectively extends the waveguide 348, and propagate into the ambient environment from the mouth 140. Referring also to FIGS. 5, 6, and 8, it can be seen that in the section of the waveguide 348 where the ribs 536 are located on the hub portion 254, i.e., near the exit side of the phasing plug 244, most of the volume available for the propagation of sound waves is provided by the recesses 560 interposed between adjacent ribs 536. By means of their protruding thicknesses, the ribs 536 control the area of expansion until the ribs 536 merge into the hub portion 254, at which point the recesses 560 transition into the remaining (or upper) portion of the waveguide 348.

Referring primarily to FIGS. 5, 6, 8 and 9, the utilization of ribs 536—or, stated alternatively, the utilization of recesses 560 between the ribs 536—on the outer surface 340 of the hub portion 254 provides advantages. Considering that the waveguide 348 defined by the phasing plug assembly 240 essentially begins with the plurality of apertures 412 and 416 in the phasing plug 244, it can be appreciated that without the ribs 536 (or recesses 560 between the ribs 536), the total cross-sectional area for sound propagation would abruptly change at the exit side of the apertures 412 and 416, i.e., at the interface of the apertures 412 and 416 and waveguide 348 defined between the inside surface 344 of the housing 120 and the outer surface 340 of the hub portion 254. This abrupt change would result from the fact that, at this interface, the bridge sections 420 between the apertures 412 and 416 no longer exist, at which point the cross-sectional area would change from being the total area of the apertures 412 and 416 to being all of the annular area between the inside surface 344 and the outer surface 340. Conversely, in implementations such as illustrated by way of example in this disclosure, the provision of the ribs 536 (and the recesses 560 between the ribs 536) enables the utilization of a plurality of apertures 412 and 416 and a phasing plug 244 with a hub portion 254 with all of the attendant advantages but without a disadvantageous abrupt change in cross-sectional area. That is, the presence of the ribs 536 and recesses 560 provide a gradual, controlled transition for sound propagation from the apertures 412 and 416 of the phasing plug 244 to the waveguide 348 of the phasing plug assembly 240, and further provide a gradual and continuous (or substantially continuous) expansion in the cross-sectional area of the waveguide 348 from the compression chamber to the outlet 352 of the phasing plug assembly 240. This configuration improves the flatness of the frequency response and prevents undesirable perturbations of sound waves conventionally caused by discontinuities of the expansion area.

Figure 10:
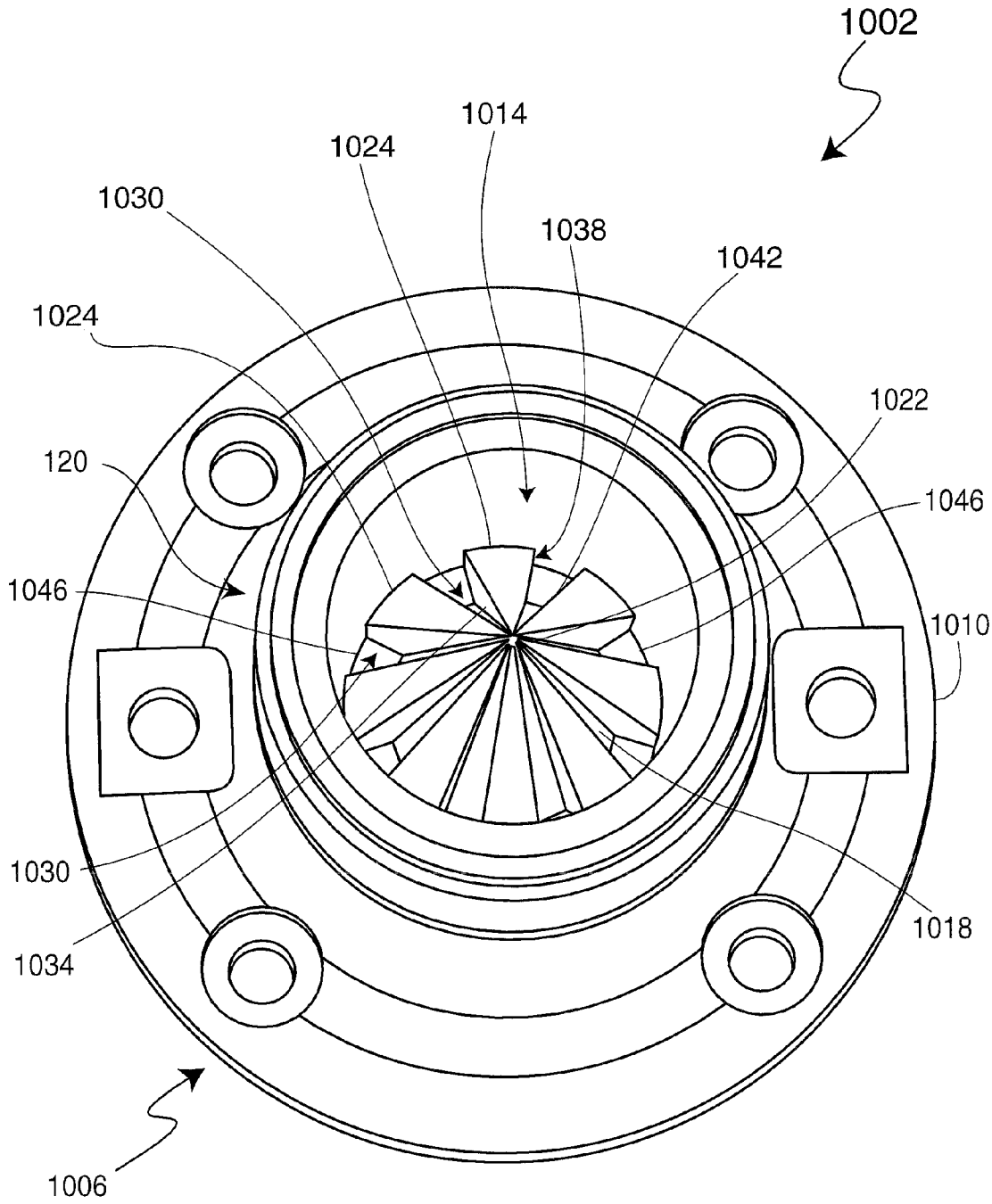
FIG. 10 is a perspective view of a phasing plug assembly according to another implementation.
Figure 11:
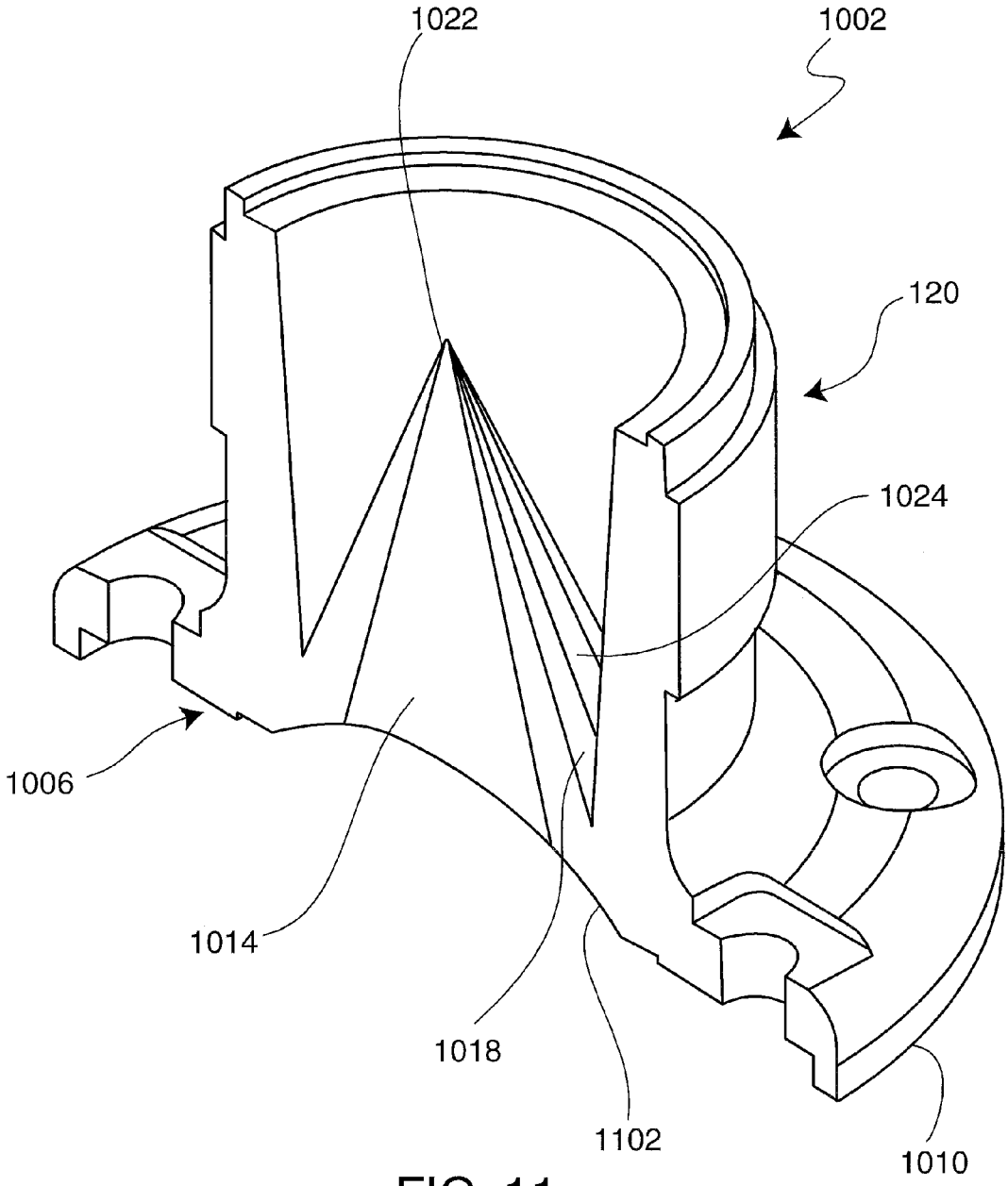
FIG. 11 is a perspective cut-away view of the phasing plug assembly illustrated in FIG. 10.
Figure 12:
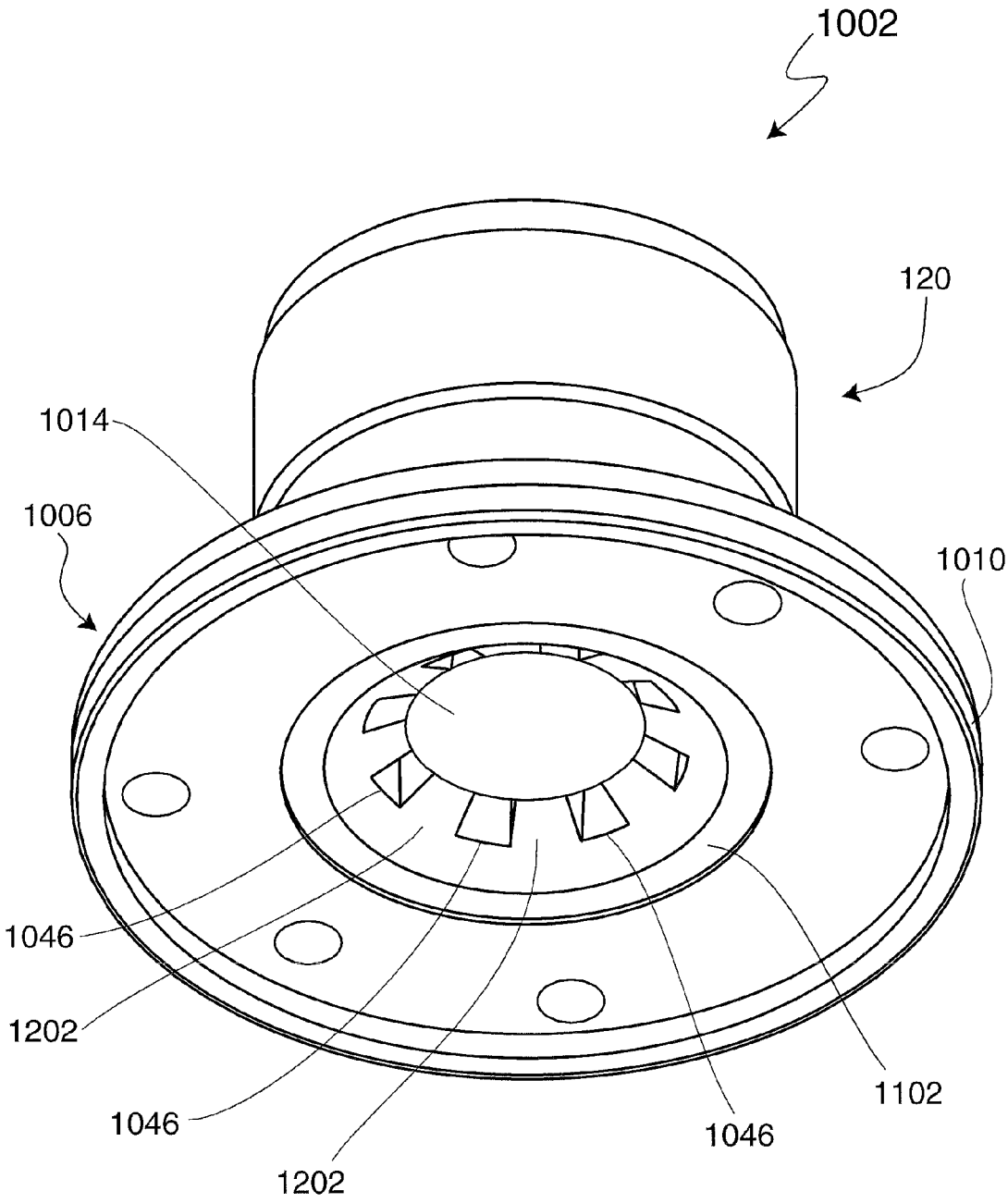
FIG. 12 is another perspective view of the phasing plug assembly illustrated in FIG. 10.

FIGS. 10-12 illustrate a phasing plug assembly 1002 according to alternative implementations. Specifically, FIG. 10 is a perspective view of the phasing plug assembly 1002 from the perspective of the top of the housing 120. The phasing plug assembly 1002 includes a phasing plug 1006 that includes a base portion 1010 and a hub portion 1014. In this example, the hub portion 1014 has an outer surface 1018 that is conical and terminates at an end or tip 1022. The hub portion 1014 includes a plurality of ribs 1024 protruding from the outer surface 1018, with pockets or recesses 1030 formed between adjacent ribs 1024. Each rib 1024 has two opposing side walls 1034 and 1038. As in the previously described implementation (see, e.g., FIG. 5), the radial thickness of each rib 1024 (i.e., the amount by which the rib 1024 protrudes outwardly from the outer surface 1018 of the hub portion 1014) tapers along the length of the rib 1024 in a direction generally from the base portion 1010 toward the tip 1022 of the hub portion 1014. Accordingly, the radial thickness of each rib 1024 decreases until the rib 1024 essentially merges into the outer surface 1018 of the hub portion 1014 at an end 1042 of the rib 1024. Additionally, in this example, the circumferential width of each rib 1024 (e.g., the width between the two opposing side walls 1034 and 1038) tapers along the length of the rib 1024 in the direction generally from the base portion 1010 toward the tip 1022 of the hub portion 1014, such that the end 1042 of each rib 1024 may be pointed. As also illustrated in FIG. 9, the recesses 1030 are deeper as compared with those illustrated in FIG. 5 to accommodate apertures 1046 of larger cross-sectional area.

FIG. 11 is a perspective cut-away view of the phasing plug assembly 1002. In this example, the base portion 1010 includes an input side 1102 that is adapted to accommodate a dome-shaped diaphragm (not shown). Accordingly, at least a portion of the input side 1102 is likewise dome-shaped. It can be envisioned in this example that the compression chamber defined between the diaphragm and the input side 1102 would likewise have a dome-shaped volume. It can also be envisioned that the input side 1102 could be modified to accommodate other shapes of diaphragms such conical and frustoconical shapes.

FIG. 12 is a perspective view of the phasing plug assembly 1002 from the perspective of the bottom of the base portion 1010. In this example, a single group of circumferentially positioned apertures 1046 are provided in the dome-shaped portion of the input side 1102. The apertures 1046 are more square-shaped as compared with those illustrated in FIGS. 4-6. Adjacent apertures 1046 are separated by solid bridge sections 1202. It can be seen that if the number of apertures 1046 (and thus bridge sections 1202) are increased in this group or, alternatively, if the circumferential dimensions of the apertures 1046 are increased, then the radial dimension of the apertures 1046 (relative to the center of the phasing plug assembly 1002) would become the dominant dimension such that the apertures 1046 could be characterized as radial slots or slits.

Figure 13:
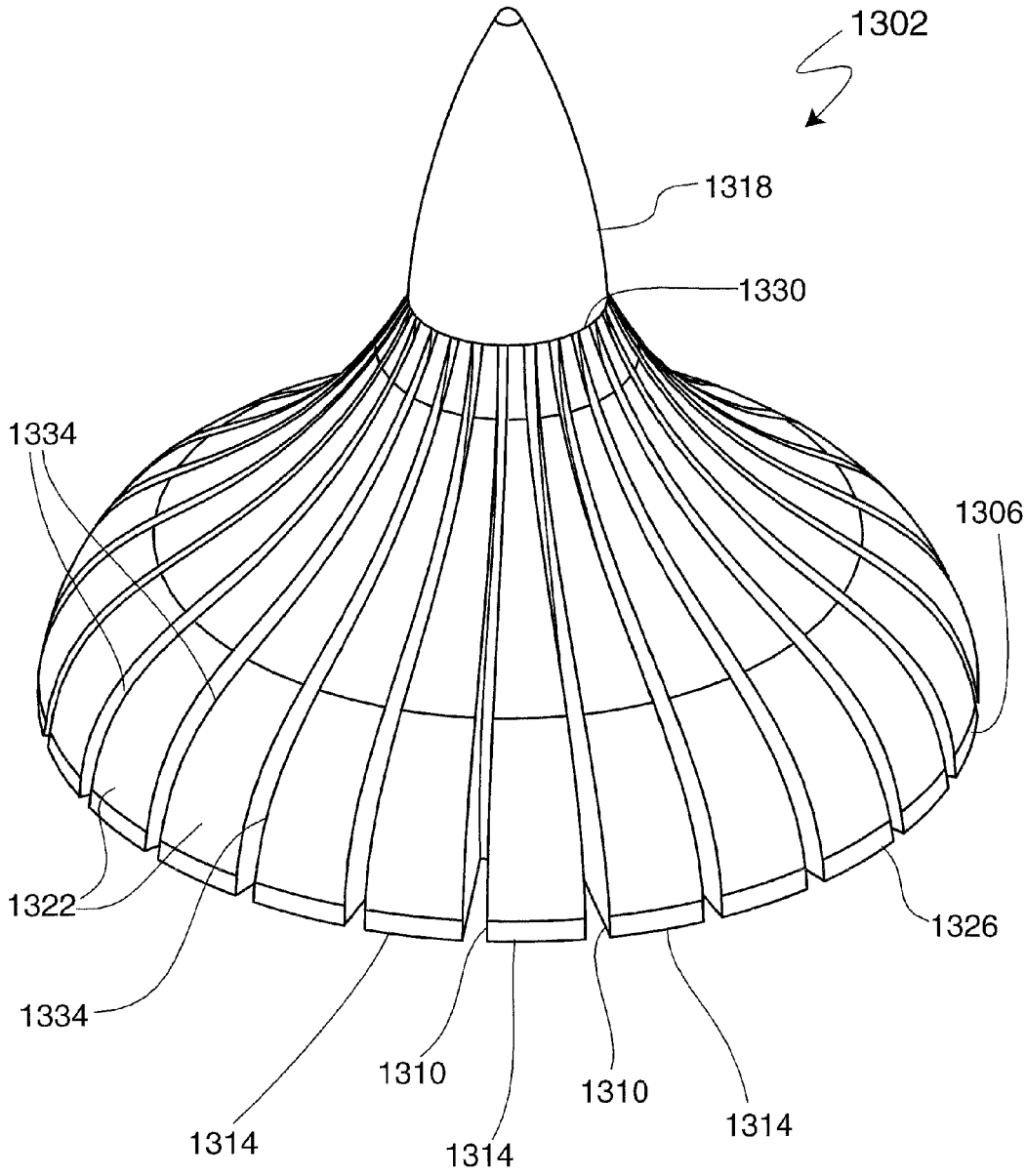
FIG. 13 is a perspective view of a phasing plug according to another implementation.
Figure 14:
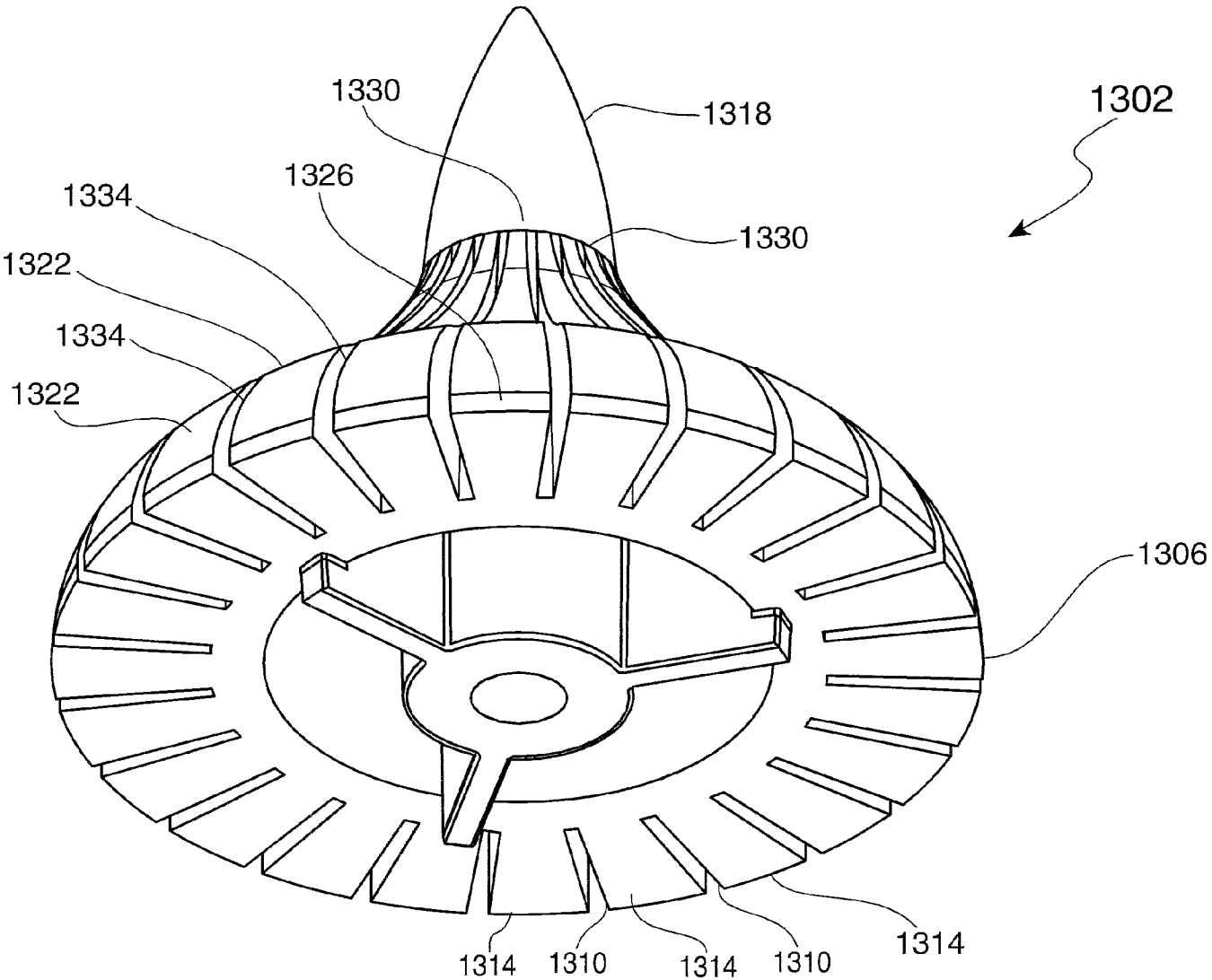
FIG. 14 is another perspective view of the phasing plug illustrated in FIG. 13.

FIGS. 13 and 14 are perspective views of a phasing plug 1302 according to another implementation. In this example, the phasing plug 1302 has a first section or base portion 1306 that has a plurality of radial apertures or slots 1310. The apertures 1310 are separated by solid bridge sections 1314. The phasing plug 1302 includes an outer surface 1318 and a plurality of ribs 1322 protruding outwardly from the outer surface 1318. Each rib 1322 has a first end 1326 at the base of the phasing plug 1302 and a second end 1330. The thickness of each rib 1322 may taper such that the second end 1330 merges into the outer surface 1318. A plurality of pockets or recesses 1334 are defined between corresponding pairs of adjacent ribs 1322, and begin at the first ends 1326 of the ribs 1322. In the example illustrated in FIGS. 13 and 14, the width of the recesses 1334 (i.e., the distance between pairs of adjacent ribs 1322) is the same or substantially the same as the width of the apertures 1310. When utilized in a compression driver, this configuration provides an uninterrupted area of expansion through which sound waves propagate. The phasing plug 1302 illustrated in FIGS. 13 and 14 may be utilized in conjunction with any type of diaphragm (annular, domed, conical, or the like) provided in a compression driver. It will be understood that a separate base portion (not shown) may be provided at the base of the phasing plug 1302, in which case the structure illustrated in FIGS. 13 and 14 may be characterized as being the hub portion of a phasing plug. The separate base portion may include radial apertures 1310 aligned with the radial apertures shown in FIGS. 13 and 14.

It can thus be seen that the implementations disclosed herein offer significant flexibility in the specification of compression drivers for desired applications and frequency ranges in sound production. The compression ratio may be controlled by changing the width of the bridge sections and correspondingly the width of the ribs while, at the same time, preserving the continuity of the area of expansion defined by the waveguide of the phasing plug assembly. Accordingly, the implementations disclosed herein provide flexible control over efficiency of the compression driver and over the shape of its frequency response.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A phasing plug for a compression driver, comprising:

a base portion including a first side, a second side, and a plurality of apertures extending between the first and second sides; and a hub portion extending from the base portion along a central axis of the phasing plug, the hub portion including an outer surface and a plurality of ribs disposed on the outer surface, where each rib includes a first end disposed proximate to the base portion and a second end disposed at a distance from the base portion, and each rib has a thickness by which the rib protrudes from the outer surface, where the thickness is greater at the first end than at the second end, where a plurality of recesses are defined by the outer surface and respective pairs of adjacent ribs, and where at least one aperture fluidly communicates with at least one of the recesses.

2. The phasing plug of claim 1, where the plurality of apertures are each positioned at a radius from the central axis and are circumferentially spaced from each other.

3. The phasing plug of claim 1, where the plurality of apertures include a plurality of sets of apertures, each set of apertures is positioned at a radius from the central axis different from the other sets of apertures, and in each set the apertures are circumferentially spaced from each other.

4. The phasing plug of claim 1 comprising a plurality of bridge sections, each bridge section interposed between a pair of adjacent apertures.

5. The phasing plug of claim 4, where each rib includes an end disposed at a respective bridge section.

6. The phasing plug of claim 1, where the hub portion includes a proximal end disposed proximate to the base portion and a distal end disposed at a distance from the base portion, and a radius of the outer surface from the central axis at the proximal end is greater than a radius of the outer surface at the distal end.

7. The phasing plug of claim 6, where the radius of the outer surface decreases from the proximal end to the distal end, and the outer surface has a curved profile substantially free of discontinuities between the proximal end and the distal end.

8. The phasing plug of claim 1, where the thickness decreases from the first end to the second end, and the rib has a curved outer profile substantially free of discontinuities between the first end and the second end.

9. The phasing plug of claim 8 where, at the second end, the thickness is reduced such that the rib substantially merges into the outer surface.

10. The phasing plug of claim 1, where the hub portion is substantially axisymmetrical about the central axis.

11. The phasing plug of claim 1, where the base portion includes a plurality of bridge sections, each bridge section interposed between a pair of adjacent apertures, each rib includes a rib end disposed at a respective bridge section, and each aperture fluidly communicates with at least one of the recesses.

12. The phasing plug of claim 1, where the apertures are shaped as radial slots.

13. The phasing plug of claim 1, where the apertures are substantially rectilinear-shaped.

14. A phasing plug for a compression driver, comprising:

a housing including an inner surface defining an interior and an outlet;

a base portion including a first side, an opposing second side generally facing the interior, a plurality of apertures extending between the first and second sides, and a plurality of bridge sections, each bridge section interposed between a corresponding pair of adjacent apertures; and a hub portion extending from the base portion into the housing along a central axis of the phasing plug, the hub portion including an outer surface disposed coaxially about the central axis and a plurality of ribs extending from the outer surface, each rib including a first rib end disposed at a corresponding bridge section and a second rib end disposed at a distance from the first rib end, and each rib protruding from the outer surface with a thickness, where the thickness gradually reduces from the first rib end towards the second rib end.

15. The phasing plug of claim 14, where the inner surface and outer surface cooperatively define a waveguide, and are shaped so that the cross-sectional area of the waveguide expands along the central axis from the plurality of apertures to the outlet, and in the portion of the waveguide proximate to the apertures the expansion of the cross-sectional area is controlled by the ribs.

16. The phasing plug of claim 15, where the hub portion includes a proximal end disposed proximate to the base portion and a distal end disposed at a distance from the base portion, and the radius of the outer surface relative to the central axis decreases from the proximal end to the distal end.

17. The phasing plug of claim 14 where, at the second rib end, the thickness is reduced such that the rib substantially merges into the outer surface.

18. The phasing plug of claim 17, where the second rib end is disposed at an axial distance from the outlet.

19. The phasing plug of claim 14, where the plurality of apertures include a first set of apertures positioned at a first radius from the central axis and a second set of apertures positioned at a second radius from the central axis, each aperture of the first set is radially aligned with a respective aperture of the second set relative to the central axis, and each pair of radially aligned apertures fluidly communicates with a respective recess.

20. A compression driver comprising:

a housing including an inner surface at least partially defining an interior of the housing and an inlet;

a phasing plug disposed in the housing;

a diaphragm coupled to the inlet of the housing;

a compression chamber defined between the diaphragm and the phasing plug, where the phasing plug includes a plurality of apertures providing a plurality of respective fluid passages from the compression chamber to the housing interior; and a hub portion disposed in the interior and including an outer surface, a plurality of ribs protruding outwardly from the outer surface, and a plurality of recesses interposed between respective pairs of adjacent ribs, where each rib among the ribs comprises a first end disposed proximate to the apertures and a second end disposed at a distance from the apertures, and where a thickness of each rib tapers from the first end towards the second end, and each aperture among the apertures fluidly communicates with at least one of the recesses.

21. The compression driver of claim 20, where the phasing plug includes a plurality of bridge sections, each bridge section is interposed between a pair of adjacent apertures, and each rib includes a rib end disposed at a respective bridge section.

22. The compression driver of claim 20, where the housing includes an outlet, the outer surface and at least a portion of the inner surface cooperatively define a wave guide generally extending from the apertures to the outlet, and at least a portion of the waveguide proximate to the apertures is further defined by the recesses.

23. The compression driver of claim 20, where the hub portion includes a proximal end disposed proximate to the apertures and a distal end disposed at a distance from the apertures, and a radius of the outer surface relative to an axis decreases from the proximal end to the distal end.

24. The compression driver of claim 20 comprising a horn, where the housing includes an outlet fluidly communicating with the horn.

25. The phasing plug of claim 14, where a plurality of recesses are respectively defined between pairs of adjacent ribs, each aperture provides communication with at least one recess, the inner surface and the outer surface cooperatively define a waveguide generally extending from the apertures to the outlet, and at least a portion of the waveguide proximate to the apertures is further defined by the recesses.

26. The compression driver of claim 20, where a depth of each recess among the recesses tapers along an axis from the first end of the respective pair of adjacent ribs towards the second end of the respective pair of adjacent ribs.

* * * * *